United States Patent [19]

Kohrs

[11] 4,135,671

[45] Jan. 23, 1979

[54] STOCK PULPER

[75] Inventor: Manfred Kohrs, Ravensburg, Germany

[73] Assignee: Escher Wyss GmbH, Ravensburg, Germany

[21] Appl. No.: 837,808

[22] Filed: Sep. 29, 1977

[30] Foreign Application Priority Data

Oct. 19, 1976 [CH] Switzerland ..... 13210/76

[51] Int. Cl.[2] ..... B02C 23/36

[52] U.S. Cl. ..... 241/46.04; 241/46.11

[58] Field of Search ..... 241/46.04, 46.11, 46.17, 241/230, 234, 259.1, 259.3

[56] References Cited

U.S. PATENT DOCUMENTS

| | | | |
|---|---|---|---|
| 551,382 | 12/1895 | Hudson | 241/259.3 |
| 2,716,926 | 9/1955 | Armstrong | 241/46.11 |
| 3,506,202 | 4/1970 | Cumpston, Jr. | 241/46.04 |
| 3,774,853 | 11/1973 | Seifert | 241/46.17 |
| 3,960,332 | 6/1976 | Seifert | 241/46.04 |

*Primary Examiner*—Granville Y. Custer, Jr.
*Attorney, Agent, or Firm*—Kenyon & Kenyon, Reilly, Carr & Chapin

[57] ABSTRACT

The stock pulper is provided with a means for adjusting the spacing between the arms of the rotor and the screen. In one embodiment, the adjustment can be made from without the stock pulper while in another embodiment, the adjustment can be made from within and without the stock pulper.

9 Claims, 6 Drawing Figures

STOCK PULPER

This invention relates to a stock pulper. More particularly, this invention relates to the mounting of a rotor within a stock pulper.

As is known, various stock pulpers have been known for processing waste paper so as to obtain good stock while eliminating lightweight and heavyweight impurities. Such stock pulpers are described in U.S. Pat. Nos. 3,942,728 and 3,945,576. Generally, these stock pulpers are constructed with a tank into which the waste paper can be supplied, a screen in one wall of the tank through which good stock can be passed, a rotor having radially disposed arms opposite the screen for screening the good stock through the screen and a shaft which passes into the tank to drive the rotor. In such pulpers of this type, it must be possible to adjust the distance of the arms of the rotor from the screen in dependence upon the requirements of operation. In some cases, this is accomplished by the use of washers such that when the tank is open, the rotor can be pulled off the shaft and a washer placed between the rotor and a fixed part of the shaft. Alternatively, where a washer is already in place, a larger or smaller washer can be used as a replacement. However, this procedure is laborious, and usually results in an extended downtime of the stock pulper.

Accordingly, it is an object of this invention to provide a means for adjusting the psoition of the arms of a rotor of a stock pulper relative to a screen in a relatively simple manner.

It is another object of the invention to permit the adjustment of a rotor relative to a screen in a stock pulper utilizing simple parts.

It is another object of the invention to provide for an adjustment of a rotor relative to a screen in a stock pulper from outside the stock pulper.

It is another object of the invention to make adjustments in a stock pulper without extended downtime of the stock pulper.

Briefly, the invention is directed to a stock pulper comprising a tank which defines a separation chamber and which has a wall separating the chamber from the exterior of the tank, a screen disposed in the wall for screening stock therethrough from the chamber and a rotatable shaft extending through the wall. In addition, the stock pulper has a rotor within the chamber which has a hub fixed to the shaft for rotation therewith as well as a plurality of arms which extend radially from the hub in spaced facing relation to the screen. In accordance with the invention, the hub is mounted on the shaft in axially movable relation, a bushing is disposed about the shaft in axially movable relation to the shaft, and a means is provided for moving the bushing and the hub axially of the shaft in order to adjust the spacing of the arms relative to the screen. For this purpose, the bushing extends through the wall of the tank and is disposed in abutment with the hub.

The adjustment means includes a nut which is threaded onto the shaft in abutment with the bushing outside the tank wall relative to the separation chamber in order to move the bushing along the shaft upon rotation of the nut.

In one embodiment, the adjustment means also includes a second nut which is threaded onto the shaft within the chamber. This second nut is disposed in abutment with the hub at the opposite end from the bushing in order to move the hub and bushing along the shaft upon rotation of the nut. In this case, both nuts are rotated in suitable directions in order to effect positioning of the bushing and thus the hub along the shaft.

In another embodiment, the adjustment means includes a spring disposed between the shaft and the hub within the chamber. This spring biases the hub towards the screen, bushing and the nut so as to effect a positioning of the hub upon adjustment of the nut.

In still another embodiment, the nut may be formed with a pair of threads with one of the threads threaded onto the shaft while the other thread is threaded onto the bushing. The threads are exposed to effect movement of the bushing relative to the shaft upon rotation of the nut. In one case, the threads may be of opposite direction while, in another case, the threads may be of different pitch. In addition, the bushing is threaded into the hub so as to permit an adjustment to be carried out from outside the stock pulper.

In order to effect an adjustment of the hub from outside the stock pulper, the bushing is generally threaded or otherwise secured to the hub. In those cases where an adjustment can be made from within the stock pulper, the bushing need only be placed in abutment with the hub so long as there is a suitable means within the stock pulper tank which can be adjusted, for example, a nut as noted above or a biasing spring.

In the above embodiments a seal is provided between the bushing and the wall in order to prevent leakage out of the stock pulper.

The invention thus provides a technique for permitting a certain movement of the rotor on the shaft without moving of the shaft. In this way, the shaft may remain fixed axially within the bearings used to mount the shaft. This results in a simplified arrangement.

Where use is made of a threaded nut to effect the adjustment, a very simple adjusting means is obtained which is suitable for exerting large forces which may, at times, be necessary for adjusting the hub.

These and other objects and advantages of the invention will become more apparent from the following detailed description and appended claims taken in conjunction with the accompanying drawings in which:

Figure 1:
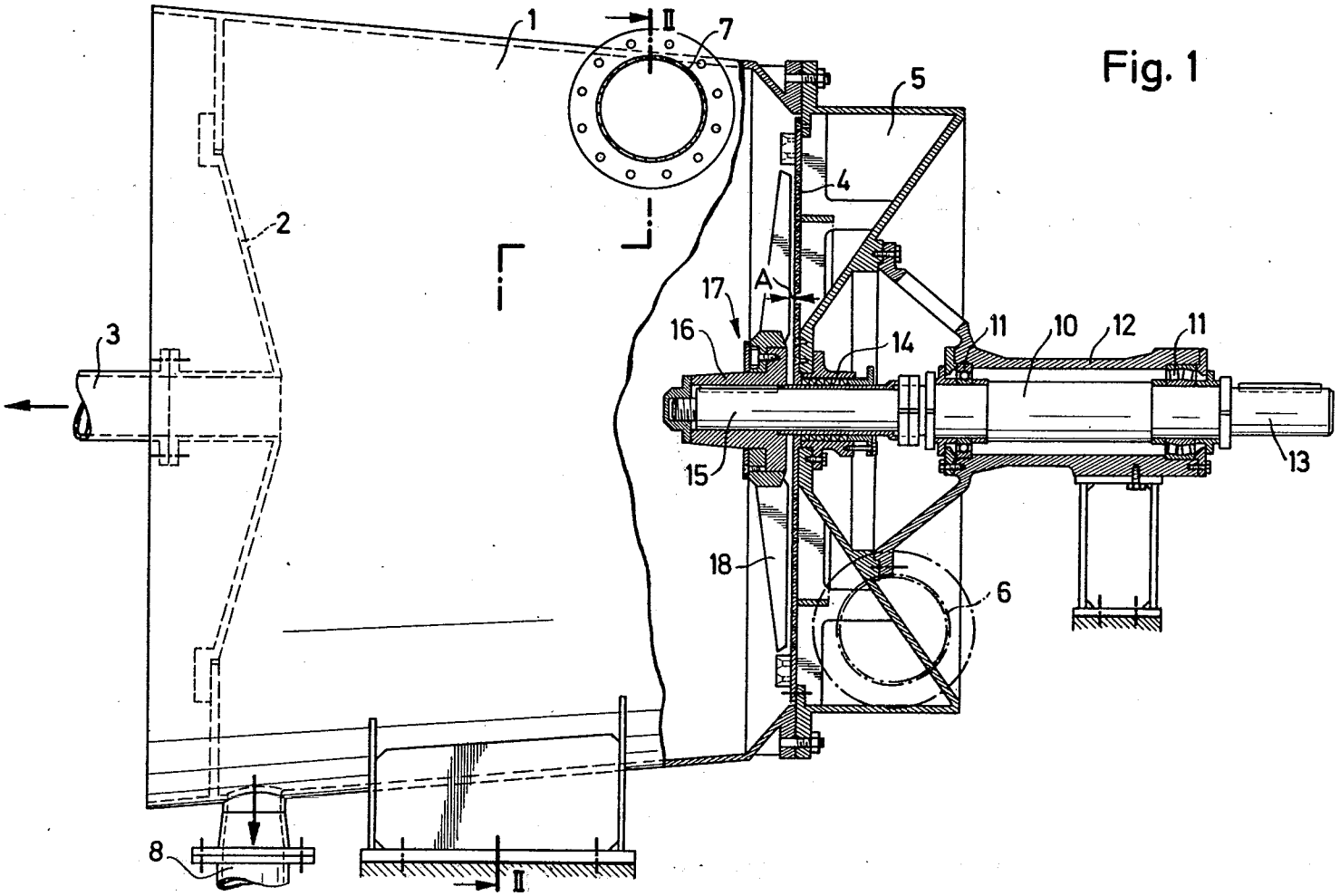
FIG. 1 illustrates a cross-sectional view through a stock pulper having an adjustment means in accordance with the invention.
Figure 2:
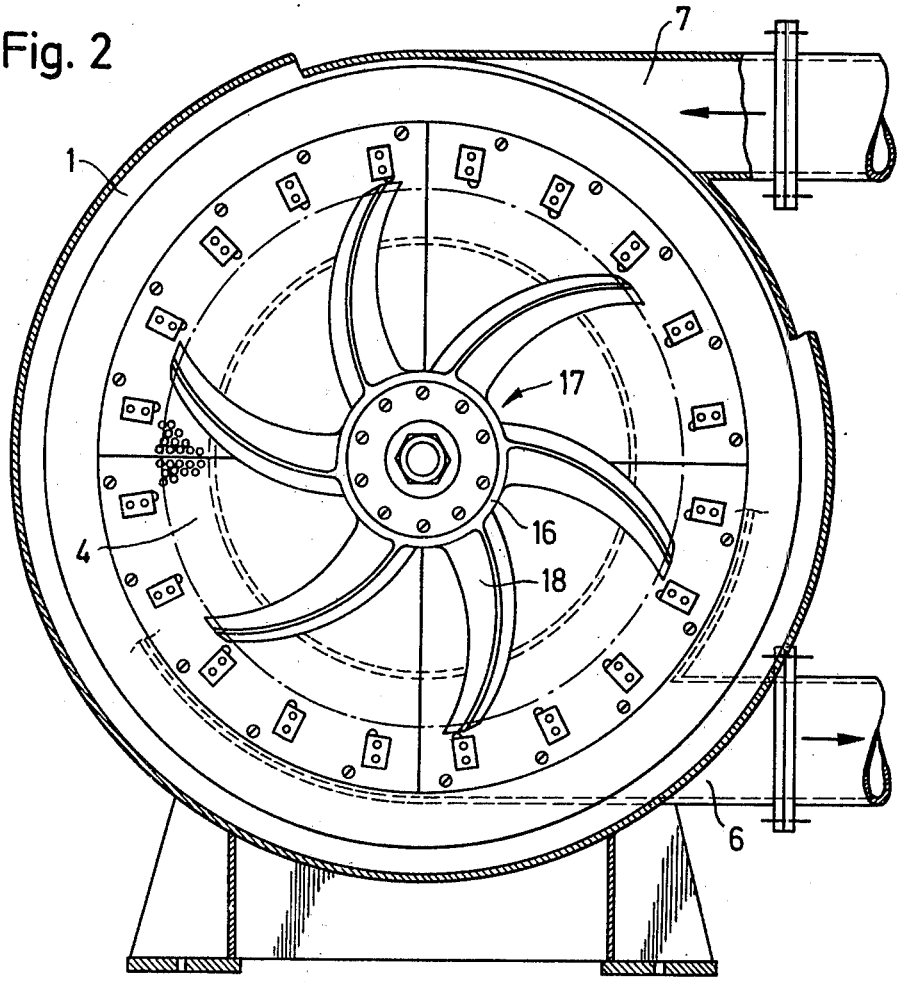
FIG. 2 illustrates a view taken on line II—II of FIG. 2.

Referring to FIGS. 1 and 2, the stock pulper which is useful for processing a pulp obtained from waste paper, particularly for use in the manufacture of new paper, is of a construction similar to that described in U.S. Pat. Nos. 3,942,728 and 3,945,546. As shown, the stock pulper comprises a tank 1 which defines a separation chamber in which the waste paper can be processed. The tank 1 is closed off by a cover 2 from which a line 3 extends for the discharge of lightweight impurities which are separated from the waste paper within the chamber. The tank also has a wall opposite the cover 2 to separate the chamber from the exterior of the tank 1. This latter wall has a screen 4 disposed therein for screening stock therethrough from the separation chamber. As shown, the screen is in the form of a perforated plate. In addition, a plenum 5 is disposed outside the screen 4 to accumulate the good stock while a line 6 extends from the plenum 5 to discharge the stock. The tank 1 is also provided with an inlet line 7 for the material to be treated and an outlet line 8 for the discharge of heavy weight constituents from the separation chamber.

Referring to FIGS. 1 and 2, a rotatable shaft 10 extends through the wall in which the screen 4 is mounted. This shaft 10 is rotated by any suitable means and is mounted via bearings 11 in a bearing housing 12. The shaft 10 includes a drive stub 13 which is connectable to a suitable drive (not shown) and is carried through a seal 14 in the wall of the tank 1. In this way, a free end 15 of the shaft protrudes into the separation chamber of the tank 1.

A rotor 17 is disposed within the separation chamber of the tank 1. This rotor 17 has a hub 16 which is mounted on the shaft end 15 in axially movable relation and is fixed to the shaft 10 for rotation therewith. The hub 16 has a plurality of arms 18 which extend radially therefrom in spaced facing relation to the screen 4 by a distance A.

Figure 3:
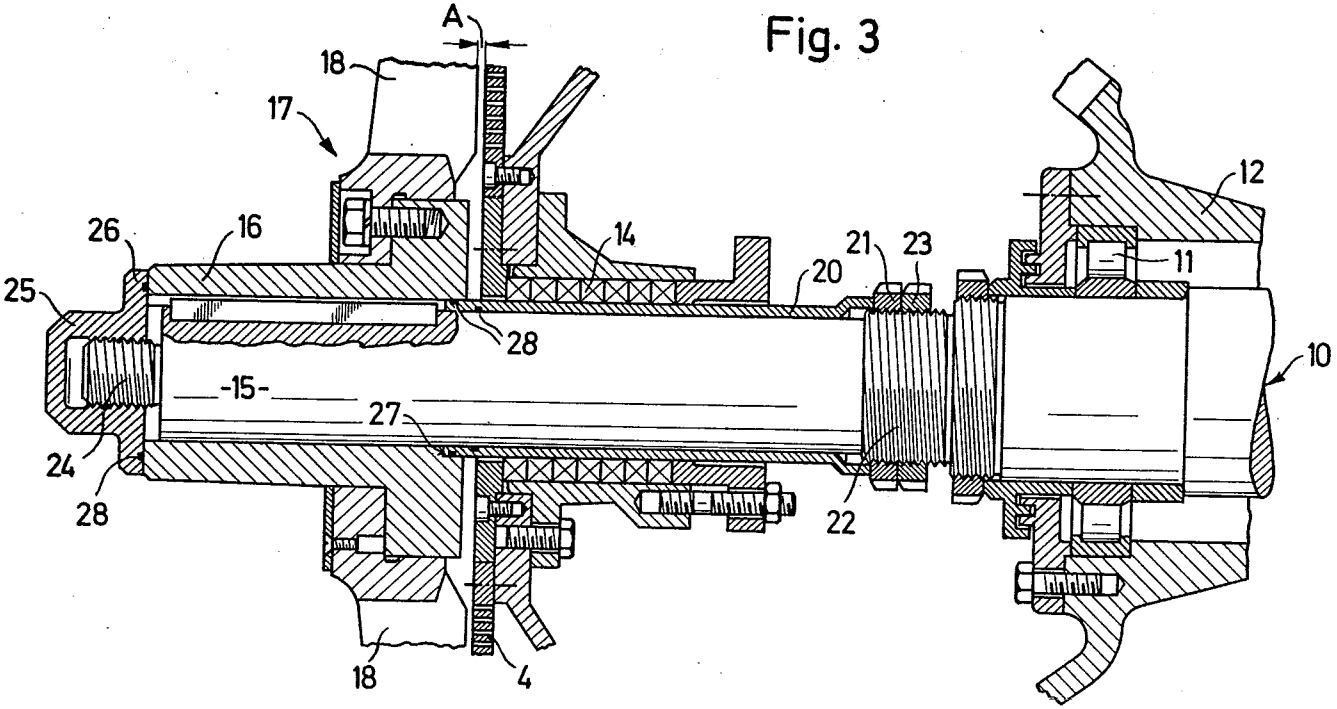
FIG. 3 illustrates a sectional view from FIG. 1 to an enlarged scale.

Referring to FIG. 3, a cylindrical bushing 20 is disposed about the shaft 10 in axially movable relation to the shaft 10. This bushing 20 extends through the wall in which the screen 4 is mounted and is disposed in abutment with the hub 16. As shown, a seal is disposed within the frame of the stock pulper between the bushing 20 and the wall.

In addition, a means is provided for moving the bushing 20 and the hub 16 axially of the shaft 10 in order to adjust the spacing A of the arms 18 relative to the screen 4. As shown, this adjustment means includes a nut 21 which is threaded onto the shaft 16 outside of the wall relative to the separation chamber. The nut 21 is disposed in abutment with the bushing 20 in order to move the bushing 20 along the shaft 10 upon rotation of the nut 21 in a direction towards the hub 16. A counternut or ring 23 is also threaded onto the shaft 10 to secure the position of the threaded nut 21. In addition, a second nut 25 is threaded onto a threaded end 24 on the free end 15 of the shaft 10 within the chamber. This nut 25 has a flange 26 which is disposed in abutment with the hub 16 in order to move the hub 16 along the shaft 10 upon rotation of the nut 25 towards the screen 4.

As shown in FIG. 3, a shoulder 27 is machined in a bore of the hub 16 against which one end of the bushing 20 is abutted. In addition, sealing rings 28, which may be in the form of O-rings, are disposed between the hub 16 and the bushing 20 as well as between the bushing 20 and the shaft 10. A similar sealing ring 28 is also disposed between the flange 26 and the hub 16.

As shown in FIG. 3, the hub 16 and the bushing 20 are arranged to be moved along the shaft 10. The distance A is determined by an appropriate adjustment of the nuts 21, 25. These nuts 21, 25 thus form an adjustment means for setting the position of the rotor 17 relative to the screen 4. If the distance A is to be made smaller, the counter nut 23 is loosened and thereafter the nut 21 is screwed to the right as viewed in FIG. 3. Thereafter, the cover 2 is removed to permit access to the interior of the tank 1 so that the nut 25 can be tightened. The position of the hub 16 can then be fixed by tightening the counter nut 23. In order to increase the distance A, a reverse operation is performed.

Figure 4:
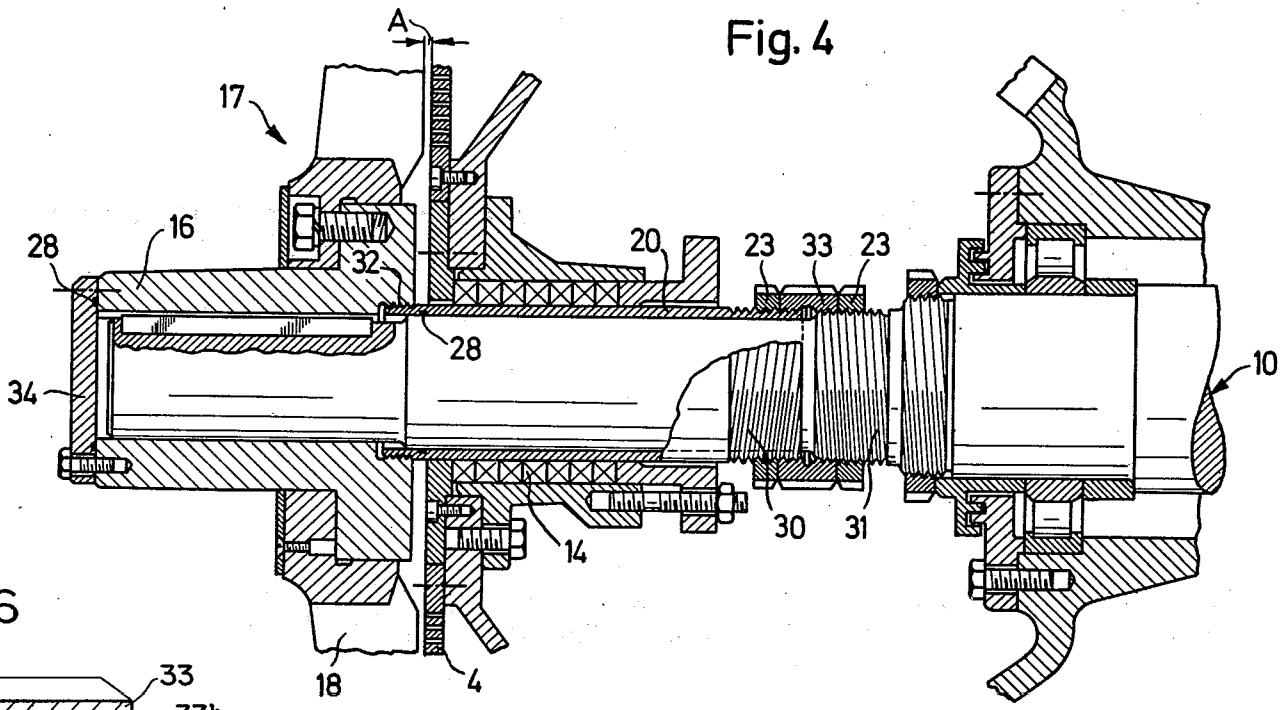
FIG. 4 illustrates a modified adjustment means in accordance with the invention.
Figure 6:
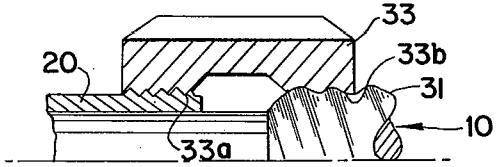
FIG. 6 illustrates a detail of a modified adjustment means in accordance with the invention.

Referring to FIG. 4, wherein like reference characters indicate like parts as above, the adjustment of the hub 16 can be accomplished from outside the tank without having to open the tank 1. In this regard, the bushing 20 and the shaft 10 are provided with threads 30, 31, respectively, of opposite pitch. In addition, the bushing 20 is secured to the hub 16 by a thread 32 so that not only can compression forces be transmitted, but also tension forces can be transmitted, between the bushing 20 and the hub 16. In addition, the adjustment means employs a nut 33 which has a pair of threads with one thread threaded onto the thread 31 of the shaft 10 while the other thread is threaded onto the thread 30 of the bushing 20. The threads of the nut 33 are disposed in opposite direction so as to corresponding to the threads 30, 31. In addition, two counternuts 23 are provided for securing the position of the threaded nut 33. Alternatively, instead of being of opposite direction, the two threads **33*a*, 33*b* of the nut 33 can be of different pitch (see FIG. 6**).

As shown, the bore of the hub 16 is closed off by a cover 34 which is secured to the end face of the hub 16 and is sealed against the hub by a sealing ring 28.

In use, the distance A is adjusted without opening of the tank 1. In this case, adjustment is made by turning of the threaded nut 33 in the direction desired. However, before turning of the nut 33, the counter nuts 23 must, of course, be loosened and thereafter tightened to secure the position obtained.

Figure 5:
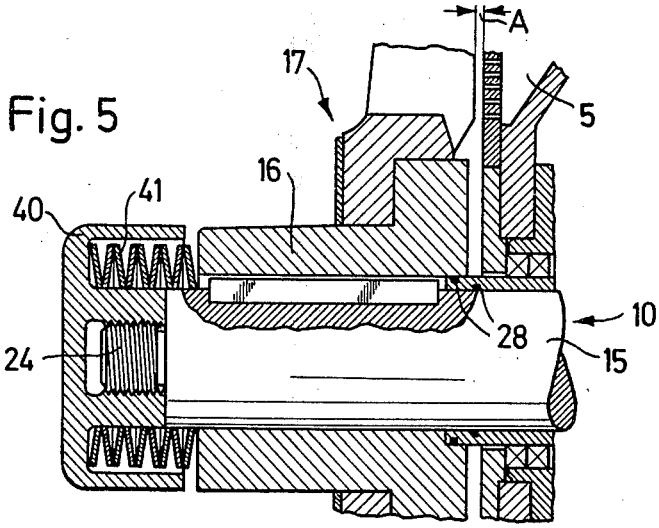
FIG. 5 illustrates a further modified adjustment means in accordance with the invention.

Referring to FIG. 5, wherein like reference characters indicate like parts as above, the adjustment means may alternatively have a construction similar to that of FIG. 3 wherein the adjustment means includes a spring 41 disposed between the shaft end 15 and the hub 16 within the separating chamber. As indicated, the spring 41 is disposed within a nut 40 which is threaded onto a threaded end 24 of the shaft end 15. The spring may be in the form of a stack of cup-springs which are biased between the nut 40 and the end of the hub 16. In this way the spring 41 serves to bias the hub 16 towards the screen 4, the bushing 20 and the adjusting nut (not shown). In this case, in order to change the distance A, only the threaded nut 21, as shown in FIG. 3, need be rotated. Thus, the hub 16 is moved to the left as viewed in FIG. 5 under the action of the threaded nut 21 and to the right as viewed under the action of the springs 41. Again, in this embodiment, the tank 1 need not be opened in order to change the position of the hub 16 on the shaft 10.

It is to be noted with respect to FIG. 4 that instead of threading the bushing 20 to the hub 16, the bushing and hub may be formed in one piece. Further, the screen 4 need not have the form of a flat perforated plate as shown but may also be conical as described in U.S. Pat. No. 3,945,576 or may have some other shape which deviates from a flat shape.

I claim:

1. In a stock pulper, the combination comprising a tank defining a separation chamber, said tank having a wall separating said chamber from the exterior of said tank;

a screen disposed in said wall for screening stock therethrough from said chamber;

a rotatable shaft extending through said wall; p1 a rotor within said chamber, said rotor having a hub mounted on said shaft in axially movable relation and fixed to said shaft for rotation therewith and a plurality of arms extending radially from said hub in spaced facing-relation to said screen;

a bushing disposed about said shaft in axially movable relation to said shaft, said bushing extending through said wall and being disposed in abutment with said hub; and means for moving said bushing and said hub axially of said shaft to adjust the spacing of said arms relative to said screen.

2. The combination as set forth in claim 1 wherein said means includes a nut threaded onto said shaft outside said wall relative to said chamber, said nut being disposed in abutment with said bushing to move said bushing along said shaft upon rotation of said nut.

3. The combination as set forth in claim 2 wherein said means further includes a second nut threaded onto said shaft within said chamber, said second nut being disposed in abutment with said hub to move said hub along said shaft upon rotation of said second nut.

4. The combination as set forth in claim 2 wherein said means further includes a spring disposed between said shaft and said hub within said chamber biasing said hub towards said screen, said bushing and said nut.

5. The combination as set forth in claim 1 wherein said means includes a nut outside said wall relative to said chamber, said nut having a pair of threads with one of said threads threaded onto said shaft and the other of said threads threaded onto said bushing, said threads being disposed to effect movement of said bushing relative to said shaft upon rotation of said nut.

6. The combination as set forth in claim 5 wherein said threads are of opposite direction.

7. The combination as set forth in claim 5 wherein said threads are of different pitch.

8. The combination as set forth in claim 1 which further comprises a seal between said bushing and said wall.

9. In a stock pulper, the combination comprising a tank defining a separation chamber, said tank having a wall separating said chamber from the exterior of said tank;

a screen disposed in said wall for screening stock therethrough from said chamber;

a rotatable shaft extending through said wall;

a rotor within said chamber, said rotor having a hub mounted on said shaft in axially movable relation and fixed to said shaft for rotation therewith and a plurality of arms extending radially from said hub in spaced facing-relation to said screen;

a bushing disposed about said shaft in axially movable relation to said shaft, said bushing extending through said wall and being disposed in threaded engagement with said hub; and means for moving said bushing and said hub axially of said shaft to adjust the spacing of said arms relative to said screen.

* * * * *

UNITED STATES PATENT AND TRADEMARK OFFICE

CERTIFICATE OF CORRECTION

PATENT NO. : 4,135,671

DATED : January 23, 1979

INVENTOR(S) : Manfred Kohrs

It is certified that error appears in the above-identified patent and that said Letters Patent are hereby corrected as shown below:

Column 4, line 65, after "wall;" delete --pl--

Signed and Sealed this

*Twenty-fifth* Day of *September 1979*

[SEAL]

*Attest:*

LUTRELLE F. PARKER

*Attesting Officer* *Acting Commissioner of Patents and Trademarks*